US009452330B2

(12) United States Patent
Savarese et al.

(10) Patent No.: US 9,452,330 B2
(45) Date of Patent: Sep. 27, 2016

(54) GOLF CLUB GRIP WITH USER NOTIFICATION AND TRACKING CAPABILITY

(71) Applicant: Radar Corporation, San Ramon, CA (US)

(72) Inventors: Chris Savarese, Danville, CA (US); Susan McGill, Redwood City, CA (US)

(73) Assignee: Tag Golf, LLC, Ridgeland, MS (US)

( * ) Notice: Subject to any disclaimer, the term of this patent is extended or adjusted under 35 U.S.C. 154(b) by 127 days.

(21) Appl. No.: 14/152,912

(22) Filed: Jan. 10, 2014

(65) Prior Publication Data

US 2014/0197951 A1 Jul. 17, 2014

Related U.S. Application Data

(60) Provisional application No. 61/751,760, filed on Jan. 11, 2013.

(51) Int. Cl.

| | |
|---|---|
| ***G08B 21/00*** | (2006.01) |
| ***A63B 53/14*** | (2015.01) |
| *A63B 49/08* | (2015.01) |

(52) U.S. Cl.

CPC ..... *A63B 53/14* (2013.01); *A63B 60/16* (2015.10); *A63B 49/08* (2013.01); *A63B 2220/833* (2013.01); *A63B 2225/15* (2013.01); *A63B 2225/54* (2013.01)

(58) Field of Classification Search

None

See application file for complete search history.

(56) References Cited

U.S. PATENT DOCUMENTS

| | | | | |
|---|---|---|---|---|
| 8,226,495 | B2 | 7/2012 | Savarese et al. | |
| 8,517,850 | B1 * | 8/2013 | Beno et al. | 473/221 |
| 8,624,738 | B2 | 1/2014 | Savarese et al. | |
| 2009/0075592 | A1 * | 3/2009 | Nystrom et al. | 455/41.1 |
| 2012/0139729 | A1 | 6/2012 | Savarese et al. | |
| 2013/0144411 | A1 | 6/2013 | Savarese et al. | |
| 2013/0287211 | A1 * | 10/2013 | Rhelimi | 380/270 |

* cited by examiner

*Primary Examiner* — Ojiako Nwugo

(74) *Attorney, Agent, or Firm* — Blakely, Sokoloff, Taylor & Zafman LLP

(57) ABSTRACT

Methods and apparatuses related to golf club grips with attached or embedded RFID tags are described. In an embodiment, a RFID tag is attached to or embedded into a golf club grip and a RFID reader incorporated into a personal computing device may read or capture information associated with the RFID tag. The device may be configured to provide notifications to the golfer based on the captured information.

16 Claims, 9 Drawing Sheets

FIG 1
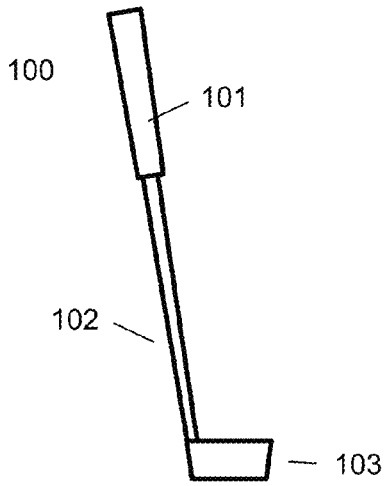
FIG 2
FIG 2A
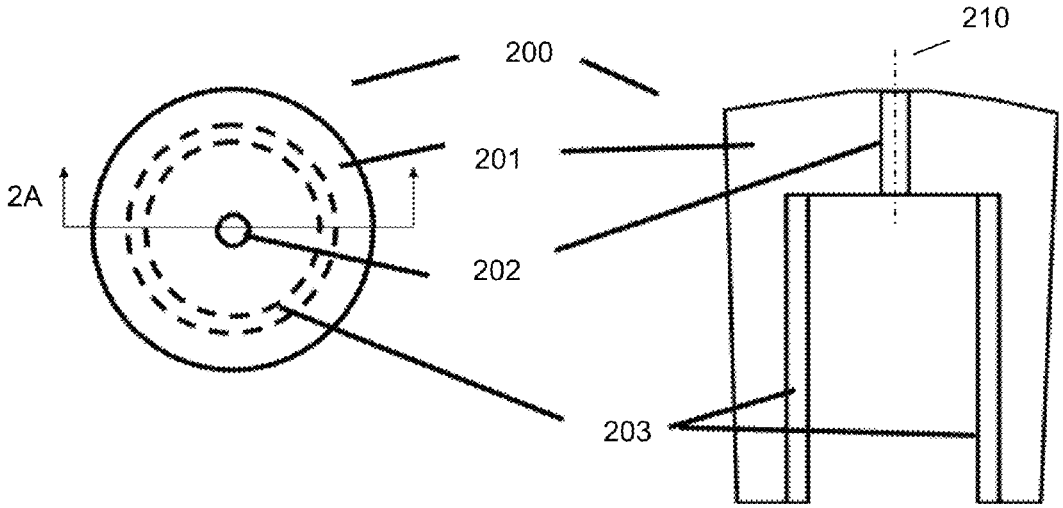

TOP VIEW

SIDE VIEW

FIG 6
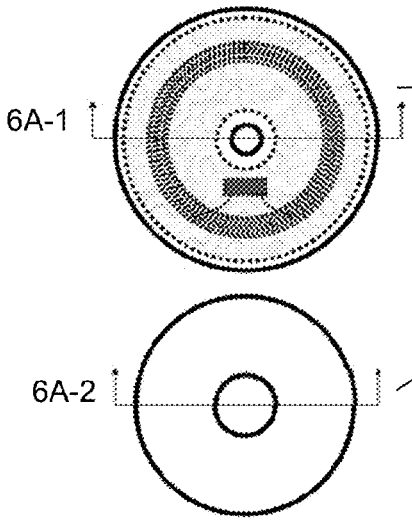
FIG 6A
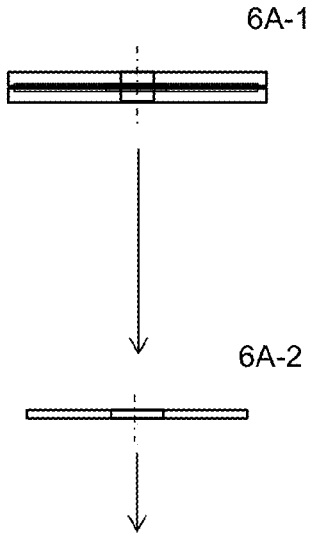
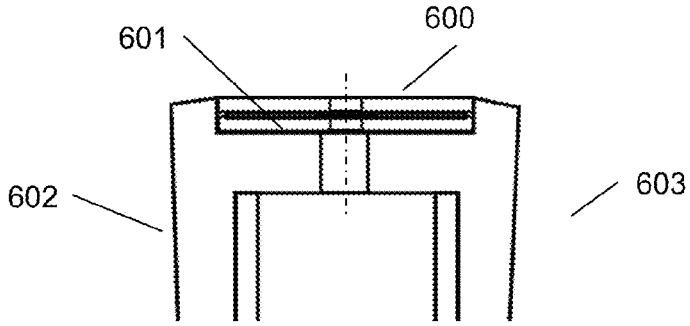
FIG 6B

GOLF CLUB GRIP WITH USER NOTIFICATION AND TRACKING CAPABILITY

This application claims priority to U.S. Provisional Patent Application No. 61/751,760, filed Jan. 11, 2013.

FIELD

Embodiments relate to sports, such as golf, and more particularly to golf club grips with embedded or attached radio frequency identification (RFID) tags.

BACKGROUND

Golf is a popular sport played with golf equipment including golf clubs and golf balls. Each golf club includes a head (the part that strikes the golf ball), a shaft, and a grip (the part where the golfer holds the club). When a golfer purchases a golf club it typically has the head, shaft and grip attached. It is common for the golfer to re-grip the golf club when the grip becomes worn over time. It is also common for a golfer to switch grips as a matter of preference of one type of grip over another. RFID tags may be attached, embedded, or otherwise affixed to golf clubs, and the RFID tags may be used to track and/or compile information about the golf clubs.

Prior art does not teach the concept of a golf grip with an embedded or attached RFID tag that may be configured to facilitate notification of a golfer, e.g., of usage information related to the golf grip. Further, prior art does not teach filtering techniques that may allow certain users to see certain data about a golf grip (or golf club the grip is attached to) while allowing other users to see other data about the same golf grip (or golf club the grip is attached to).

SUMMARY OF THE DESCRIPTION

Apparatuses, methods and systems relating to RFID tags affixed to golf grips (which may be affixed to golf clubs); where the RFID tags are configured to communicate with RFID-enabled devices which may transfer information to a database, and multiple variations and uses of such apparatuses, methods and systems are described herein. It should be understood that although some of the embodiments are primarily related to golf club grips, other embodiments could be applied to grips attached to different objects, or to other objects, as well. As a non-limiting example, RFID tags may be affixed to a tennis racket grip or to a golf club shaft.

In an embodiment, a passive, near field communication (NFC) RFID tag may be permanently or semi-permanently affixed to a golf grip and users may use RFID-enabled devices to read or write information from or to such RFID tags. The information read from or written to the RFID tags may be associated with a database. Certain users with certain versions of an application residing on the RFID-enabled device and/or certain access rights can see certain information related to the tagged equipment and other users with other access rights or application versions may see other information.

In an embodiment, passive RFID tags (such as NFC tags) embedded in or attached to golf club grips may be used alone (e.g. without accompanying bar codes, or other marking mechanisms, etc.) on the tagged equipment at the point for manufacture or distribution, for purposes of equipment tracking.

In an embodiment, information accumulated by users may be uploaded from a RFID-enabled device to a data processing system (e.g. a server) used by the manufacturer or manufacturers or retailers or other distributors, either directly from the device (e.g. through a WiFi or Ethernet or cellular telephone connection provided by the device, or other coupled personal computing device), or the accumulated information may be transferred to another device (e.g. a laptop computer or other data processing system) which in turn may upload the accumulated information (e.g. via the Internet) to the data processing system used by the manufacturer or manufacturers or retailers or other distributors.

In an embodiment, an active RFID tag, such as a 2.4 GHz Bluetooth tag, may be in communication with a reading device to create a system. A tag may include an antenna, a transmitter or RFID chip, microprocessor and optional sensors. The tag may communicate with the device (e.g. golf GPS device, personal computing device, wearable electronics, etc.) and may be affixed to a grip, such grip attached to a golf club. A combination of club tag types (e.g. active and passive) and other marking media (e.g. bar codes) may be affixed to the golf grip and/or club for purposes of recording and tracking information unique to such club.

Methods of obtaining information about golf clubs after golf clubs are distributed are described. In an embodiment, a method includes a user associating identifiers from RFID tags to identifiers in a database. This may be performed by scanning a bar code or by reading the RF transmission from the tags on the golf clubs or by reading the tags with a RFID reader. This is performed prior to distributing the golf clubs. When an end-user device (e.g. golf GPS device) or other mobile device transmits the information (e.g. uploads the information wirelessly via the Internet to a database), the information may include the identifiers previously recorded, which may allow the golf club manufacturers or golf equipment distributors to associate the information with the previously stored identifiers for each golf club or tag.

Methods of obtaining information about golfer's behavior are described. In an embodiment, a user, such as a golf club manufacturer, may read the unique identifier in the grip/club-affixed (i.e. tag is affixed to grip and grip is affixed to club) RFID tag and store the identifier in a database. The user may distribute the golf equipment with the affixed RFID tags, after having read and stored the unique identifiers in a database. An end-user (e.g. golfer) may purchase the golf equipment at a golf retail location and, likely as part of a tag-specific or golf-specific application on a smart phone or other device, the golfer may read the tag with a RFID-enabled device while playing golf. As the golfer plays golf and records the clubs and locations of golf shots using tagged golf clubs and RFID-enabled devices, the data may be sent (e.g. wirelessly, via the Internet) to a database. The information stored in the database may capture information about the behavior of the golfer, such as: how often the golfer plays, where the golfer plays, what type of equipment the golfer uses, how often the golfer changes equipment, etc.

Methods of reminding golfers about the state of golf grips are described. In an embodiment, a RFID tag and/or golf software application (e.g., executable on a smart phone or other device) may be configured to notify a golfer that is it time to replace the grip or re-grip the golf club. The golfer may download a software application (e.g. onto a smart phone) upon or after purchasing the tagged equipment. Upon initial registration of the golf grip using the golf application, the user may be prompted to input a regrip condition defining a duration until the golf grip is due for regripping. The golf application may track or monitor grip usage, e.g., the amount of time or number of rounds the grip is used, and prompt the golfer at the specified time when the regrip condition is met with a message that appears on the display of the golf GPS device or personal computing device.

BRIEF DESCRIPTION OF THE DRAWINGS

The present invention is illustrated by way of example and not limitation in the figures of the accompanying drawings in which like references indicate similar elements.

FIG. 1 shows a side view of a golf club.

FIGS. 2 and 2A respectively show a top view and a side cross-section view of a golf club shaft and grip.

FIGS. 6 and 6A respectively show top views and side cross-section views of a RFID assembly and a round piece of double-sided adhesive with a hole in the center.

FIG. 6B shows a side cross-sectional view of a RFID assembly installed in a recess of a golf grip.

DETAILED DESCRIPTION

Figure 3:
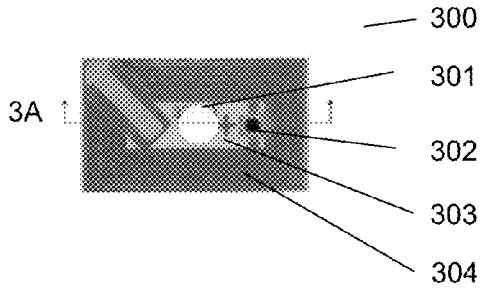
FIGS. 3 and 3A respectively show a top view and a side cross-section view of a rectangular RFID tag with a hole in the middle.

Various embodiments and aspects will be described with reference to details set below, and the accompanying drawings will illustrate the embodiments. The following description and drawings are illustrative and are not to be construed as limiting the invention. Numerous specific details such as sizes and shapes are described to provide a thorough understanding of various embodiments. However, in certain instances, well-known or conventional details are not described in order to not unnecessarily obscure the present invention in detail.

Various embodiments refer to golf club tags or tag electronics that may be built-into or affixed to golf club grips at the time of manufacture. For example, embodiments may incorporate golf club tags or tag electronics as illustrated and described in related U.S. Pat. Nos. 8,226,495 and 8,624,738, and in U.S. patent application Ser. Nos. 13/305,722, 13/633,835 and 61/740,417, which are hereby incorporated in this application by reference. FIG. 1 shows an example of a golf club 100, with a grip 101, a shaft 102 and head 103. The grip 101 is at the "butt-end" or handle end of the golf club. Golf grips come in various sizes and shapes and may be made of various materials. Grips are commonly made of rubber, but may be made of leather, synthetic leather, and various other materials. There are "one piece" grips and grips comprised of various layers of material. Grips may be manufactured by molding and curing (i.e. vulcanizing) rubber material, using high heat and pressure, into a desired shape. Grips may also be manufactured by wrapping layers of material including, for example, foam and leather, around a base material to form a finished grip.

FIGS. 2 and 2A show the top portion of a typical golf club shaft and grip 200. The shaft 203 of a golf club is commonly made of metal or graphite material and is hollow in the center. The grip slides over the shaft of the club such that the "end cap" 201 is above the end of the shaft when installed. The grip includes a cap hole 202 for drainage and ventilation. The cap hole may pass through the end cap 201 along a cap hole axis 210. The cap hole 202 is an important feature of the grip because without it installation of the grip onto the shaft would be difficult if not impossible.

Figure 3A:
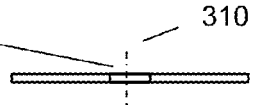

FIGS. 3 and 3A show an example of a RFID tag 300. A tag consists of a chip or integrated circuit 302 which includes a unique identifier, an antenna 304 and a substrate material 303. The chip and the antenna are connected using conductive material and the combination of the connected chip and antenna on a substrate is referred to as an inlay or tag. RFID inlays typically are provided as either "wet" (with adhesive on the substrate) or "dry" (no adhesive on the substrate). Herein the terms "tag" and "inlay" are used interchangeably. There are various types of RFID tags, including active (with battery), semi-active, and passive (no battery), to name a few. The description herein will focus primarily on passive RFID tags but it is understood that the concepts covered herein could apply to the use of any type of RFID tag. It is possible the concepts described herein could employ technologies other than RFID, including any technology that may include a unique identifying means in a "tag". Magnetic strip technology would be one example of such other technologies that could include a unique identifier in a tag.

Figure 4:
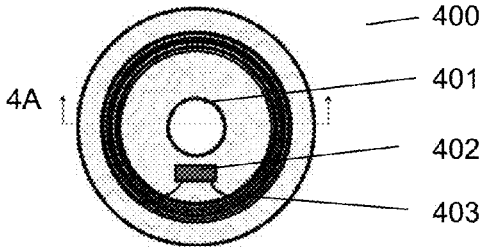
FIGS. 4 and 4A respectively show a top view and a side cross-section view of a round RFID tag with a hole in the center.
Figure 4A:
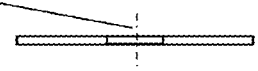

The tag 300 shown in FIGS. 3 and 3A is rectangular but tags may come in all shapes and sizes. This particular example of a tag includes a tag hole 301 in the center of the substrate of the tag. The tag hole 301 may pass through the entire RFID tag, including the substrate, along a tag hole axis 310. This hole is an important feature that serves an important function. FIGS. 4 and 4A show an example of a round RFID tag 400 with a tag hole 401 through the substrate, chip 402 and/or antenna 403. Various shapes of RFID tags are available, the shapes shown in FIGS. 3, 3A, 4, and 4A are for example purposes only.

Figure 4B:
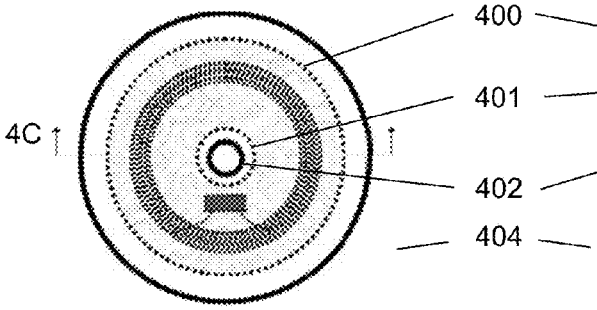
FIGS. 4B and 4C respectively show a top view and a side cross-section view of a golf club grip with a round RFID tag embedded within the end cap area of the grip.
Figure 4C:
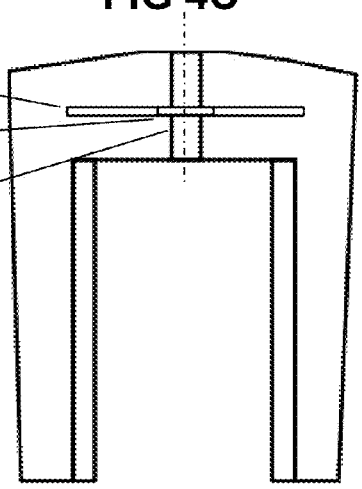

FIGS. 4B and 4C show a RFID tag 400 with a tag hole 401 embedded in a golf club grip 404 such that the tag hole 401 in the RFID tag is aligned with the cap hole 402 in the end cap of the grip. Thus, a cap hole axis, e.g., cap hole axis 210, may be collinear with a tag hole axis 310. That is, a tag hole 401 and a cap hole 402 may be concentric. In other examples, tag hole 401 and cap hole 402 may be aligned or in fluid communication, but the perimeter of the holes may be offset or non-concentric.

The configuration shown in FIG. 4C (and similar configurations) allows air, liquid, etc. to pass through the grip, which may be important to the proper installation of the grip. Further, this configuration may be important during general use of the grip when it is attached to a golf club. For example, when a golf club is in use, if the attached grip is configured such that air cannot escape during use of the golf club, the air trapped inside the golf club shaft may react to the impact of the club on a golf ball, potentially creating vibrations and/or sounds that are not acceptable to the golfer.

Figure 5:
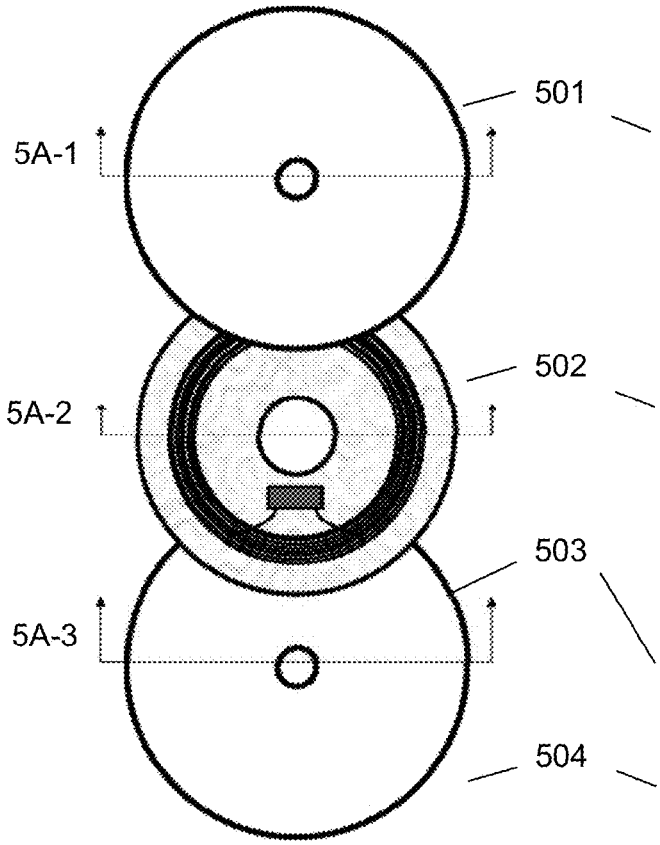
FIGS. 5 and 5A respectively show top views and side cross-section views of a round RFID tag in between two parts of round plastic, each piece with holes in the center.
Figure 5A:
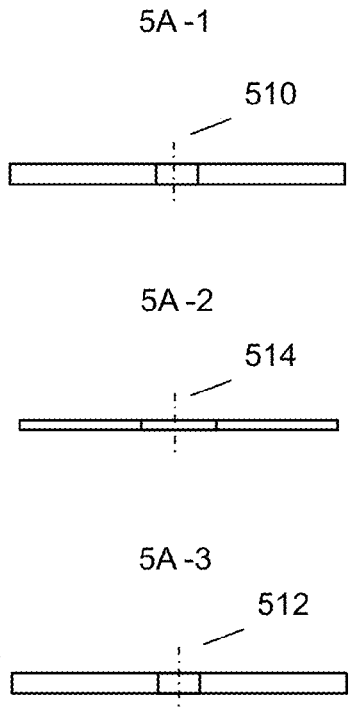

FIGS. 5 and 5A show the parts of a RFID assembly 504, including a top part 501, the RFID tag 502 and a bottom part 503. Top part 501 may include a top hole passing through top part 501 along a top hole axis 510. Similarly, bottom part 503 may include a bottom hole passing through bottom part 503 along a bottom hole axis 512. As described above, RFID tag 502 may have a tag hole passing through RFID tag along a tag hole axis 514. Furthermore, as discussed above, top hole axis 510, bottom hole axis 512, and tag hole axis 514 may be collinear, or they may be at different angles to each other and misaligned.

In an example, one or more of the holes passing through the top part 501, bottom part 503, and RFID tag 502 may have a circular cross-sectional area. In alternative examples, one or more of the holes may be non-circular. For example, the tag hole may be circular, while the top hole may have a cross-sectional area that is shaped as a star, a square, a recognizable character, e.g., a logo, etc.

Figure 5B:
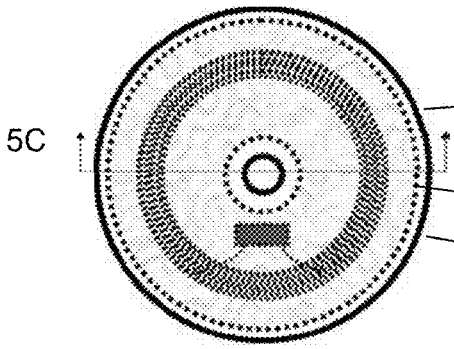
FIGS. 5B and 5C respectively show a top view and side cross-section view of a RFID assembly.
Figure 5C:
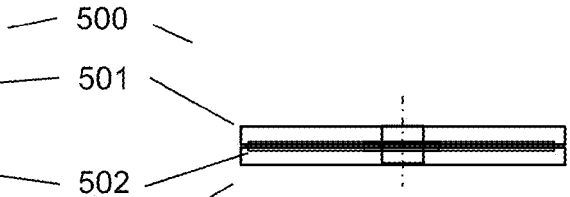

These parts may be assembled together to become one RFID tag assembly 500, as shown in FIGS. 5B and 5C. There could be additional layers of material (not shown). For example, a layer could be added on top of the top part 501, such as an additional layer including a different hardness and/or texture (e.g. a softer durometer material to match the feel of a golf grip). Several methods may be used to connect the parts 504 into one tag assembly 500. For example, a RFID inlay may be positioned between two plastic parts and the two plastic parts connected using ultrasonic welding. Other connection methods and techniques may be used including, but not limited to: spin welding, use of pressure sensitive adhesives (PSAs), use of liquid adhesives, etc. The plastic parts could be designed to snap together or screw together, etc. The inlay used may be wet or dry, laminated or not laminated, with a conductive adhesive chip-to-antenna connection or other (e.g. soldered connection). The parts 501, 502, and 503 (collectively the tag assembly parts 504) may each contain a hole through the center of the material for reasons discussed above.

Top part 501 and bottom part 503 include features to facilitate joining one part to the other. For example, one part may include a recess or channel and the other part may include a corresponding peg or post that snaps or presses into the channel. Thus, the parts may be joined by an interference or resistance fit. Alternatively, one or more raised portions or lips may be provided along an outer edge of the parts, or along an inner edge near the holes passing through the parts. Thus, top part 501 and bottom part 503 may be joined in at least one location lateral to the encased RFID tag 502. These raised portions may be appropriately flat and dimensioned to contact one another when the parts are brought together. Thus, an ultrasonic welder may be used to join the parts together at the raised portions or lips.

FIGS. 5B and 5C show the assembled RFID tag assembly 500. It should be understood this tag assembly could be manufactured in other ways, including injection molding plastic around the RFID tag. Parts 501 and 503 may be plastic. In other examples, parts 501 and 503 may be formed from other materials, such as ceramics, polymeric composites, or other non-metallic materials. Furthermore, each of part 501 and 503 may be formed from different materials. For example, bottom part 503 may be a plastic while top part 501 may be ceramic to provide a unique aesthetic, e.g., contrast, to the assembled golf club grip with RFID assembly. In an example having top part 501 and bottom part 503 formed from dissimilar materials, adhesives may be used to join the parts.

FIGS. 6 and 6A show an assembled RFID tag assembly 600 (same as 500) and a piece of double-sided pressure sensitive adhesive (PSA) 601, both with a hole in the center. The tag assembly 600 may be attached to a golf grip using a pressure sensitive adhesive 601 positioned between the tag assembly 600 and the grip 602, as shown in FIGS. 6, 6A and 6B. Ideally, the PSA 601 would be formulated to bond very well to the material of the grip 602 and to the material of the tag assembly 600, such that the golfer cannot easily remove the tag 600 from the grip 602. FIG. 6B shows the tag assembly 600 installed inside a golf grip 602 using PSA 601, forming finished grip assembly 603. The golf grip 602 is designed to include a recessed area to receive the tag assembly 600, such that the assembled grips have the appearance (and functionality) of a regular golf grip.

It may be desirable for the RFID tag to be permanently or semi-permanently affixed to the golf grip. Various designs are possible, providing permanent, semi-permanent or temporary attachment of the RFID tag to the golf grip. In one example, the RFID tag is molded directly into the grip during the grip manufacturing process. This example would be considered permanent attachment of the RFID tag to the grip. In configuration 603 shown in FIG. 6B, the attachment of the RFID tag relies on the strength/formulation of the adhesive between the grip and the tag. This may allow for relatively easy removal of the RFID tag, which may be undesirable. Additional features may be added to the RFID tag assembly to allow for more permanent attachment of the RFID tag while maintaining the aesthetics and functionality of the grip.

A user (e.g. golf equipment manufacturer) may desire to maintain or have access to a database of golf equipment sold (e.g. golf clubs). This database may contain detailed information about the equipment. For example, in the case of golf clubs, the database may contain club-specific data that includes details of the various components of the club, such as shaft material, club head loft, etc. The database may also include grip-specific data that includes details of the golf grip, such as type of grip, grip manufacturer, grip material, etc. A tag may be included permanently or semi-permanently in the golf club grip, and optionally a corresponding bar code label could be attached temporarily to the outside of the grip. The bar code may contain the same identifier as contained in the tag (or the bar code identifier could be associated with the tag identifier in a database) and the bar code label may travel with the tag throughout the manufacturing process of the tag. In an embodiment, when the tag is embedded in the golf grip, the bar code label is attached to the exterior of the grip. Thus, golf equipment manufacturers may use bar code reading equipment (that they are likely already set up with). After the golf club is assembled, the bar code may be scanned by the equipment manufacturer and the specific components may be recorded into the equipment manufacturer's database.

Figure 7:
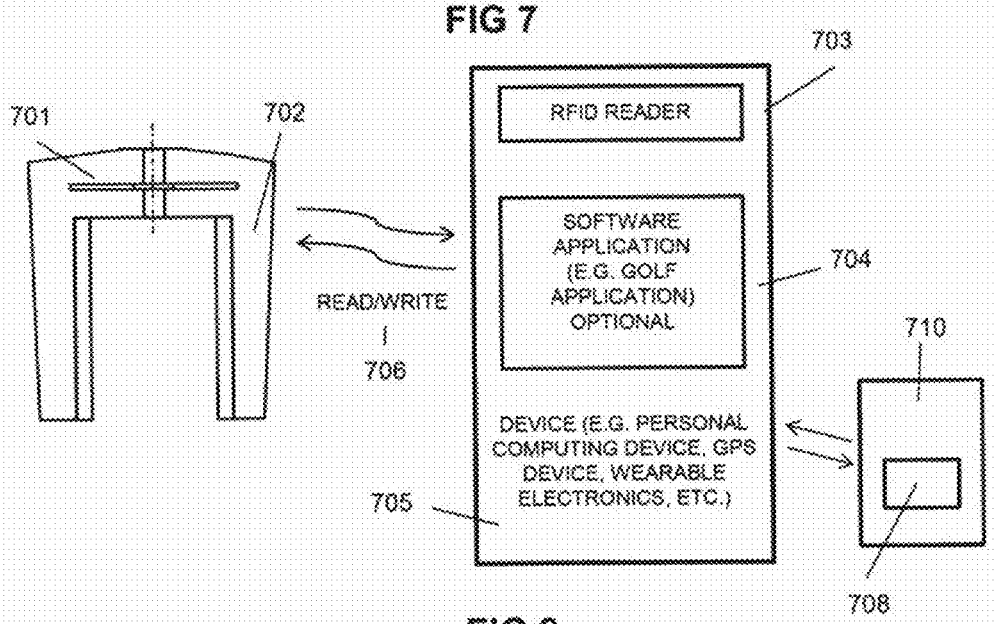
FIG. 7 shows a side cross-sectional view of a RFID tag embedded in a golf club grip and a representation of a RFID reader incorporated into a device, such as a personal computing device, golf GPS device, wearable electronics, etc., networked with a server.

In an embodiment, as shown in FIG. 7, a passive RFID tag 701, such as a near field communication (NFC) RFID tag having a unique identifier (UID), may be permanently included in the golf club grip 702. A user (e.g. golf equipment manufacturer, retailer, golfer, etc.) may use a device 705 equipped with a RFID reader 703 and an application 704 (optionally a golf-specific application) to read or write information to or from the tag, as indicated by 706. A user, such as a retailer or manufacturer, may write information to the RFID tag 701, such as custom details about each component of the golf club, e.g., club-specific information. Alternatively, a user, such as a retailer or manufacturer, may read a unique identifier from the tag 701 and store such unique identifier in a database. For example, the database may be a tag identification database 708 stored on a data processing system, e.g., server 710. Prior to storing the unique identifier, data including the unique identifier may be transmitted to server 710 via the Internet or other means. Data, including and in addition to the unique identifier, may be communicated in either direction between server 710 and device 705.

Such unique identifier may be associated with other information about the specific piece of equipment (e.g. such as custom details about each component of the golf club). These details may include date of assembly and distribution, name and location of the retailer the club is being shipped to, specifications about the golf club and grip, links to web sites for additional information, etc. Certain read privileges may be associated with certain users. For example, the end-user (e.g. golfer) may use a device 705 equipped with a RFID reader 703 to read the tag on the golf club. This RFID reader 703 may be incorporated into a device 705 (e.g. cell phone, golf GPS device, personal computing device, tablet) and the RFID reader 703 may work in conjunction with a golf data collection application or other application 704 that may be implemented in such a device. The device 705 may be granted limited access rights to information stored in tag identification database 708 or tag 701. For example, device 705 may request information from database 708, and the request may include (or not include) data representing access rights, e.g., a key. In response to receiving the request and evaluating the access rights of device 705, some information may be provided to device 705, but not other information. For example, device 705 may be allowed to retrieve information related to golf club specifications associated with tag 701, but be denied access to retailer information associated with tag 701.

Similarly, a representative of the golf club manufacturing company may read the tags 701, using the same type of device(s) 705 as the end-user (e.g. golfer), but the manufacturing representative may be granted access rights to information in the tag 701 or database 708 that end-users cannot see. For example, the representative may have a key or code stored in device 705 that can be provided with a request to access information related to distribution date, retailer the product was shipped to, etc. The key may be evaluated to determine that the representative has been granted access rights to view the information, and the information may be provided from database 708 or tag 701 to the representative, in response. Such filtering or granting of rights to certain information can be accomplished by having an application (e.g. a smart phone application) that has different versions or has features that can only be accessed by certain parties using passwords or keys. Further, information can be stored on tags that may only be able to be accessed by applications that have certain "keys" or codes to enable access to certain information. When an end-user receives a tagged product, the data may then be tracked by the equipment manufacturer, due to the wireless communication between the club tag 701 and devices 705 that may be connected to the Internet for data uploading and downloading. The data in the club tag 701 may contain the same identifier as the optional bar code stored in the equipment manufacturer's database (or tag code may be associated with the bar code in a database). Thus, the equipment manufacturer may take advantage of observing use patterns of the golfer.

Alternatively, in lieu of including a bar code and bar code reader in the process, the data may be tracked using the tag transmissions and a RF receiver or with a passive RFID tag and RFID reader to capture the data and record it in a database. This would eliminate the need for a bar code to travel with the tag as it is manufactured but would potentially require the equipment manufacturers to modify their equipment and processes to receive the tag transmissions. Other options are to use an active tag in the club in conjunction with a passive RFID tag that could be read by a RFID reader—in lieu of active club tags plus bar code labels.

Alternatively, in an embodiment, passive RFID tags (such as NFC tags) embedded in or attached to golf club grips could be used alone (e.g. without accompanying bar codes, etc.) for equipment tracking. The users (e.g. golf equipment manufacturers) may read the unique identifier from the tag and store it in a database. Additionally, users may write detailed information to the tag, again associated with the unique identifying in the tag and the database.

The golfer could register the club online with a device company or application developer (such as a golf GPS device company or golf equipment company) so the golfer may take advantage of compiling data corresponding to the golf games played and club usage. Additionally, the system may gather information about which golf course the golfer is playing, how often the golfer uses a particular golf club and how often they golf. This information may be valuable to golf equipment retailers or equipment manufacturers and may be provided to such retailers or manufacturers. A personal computing device 705 equipped with a RFID reader 703 may collect such information.

Figure 8:
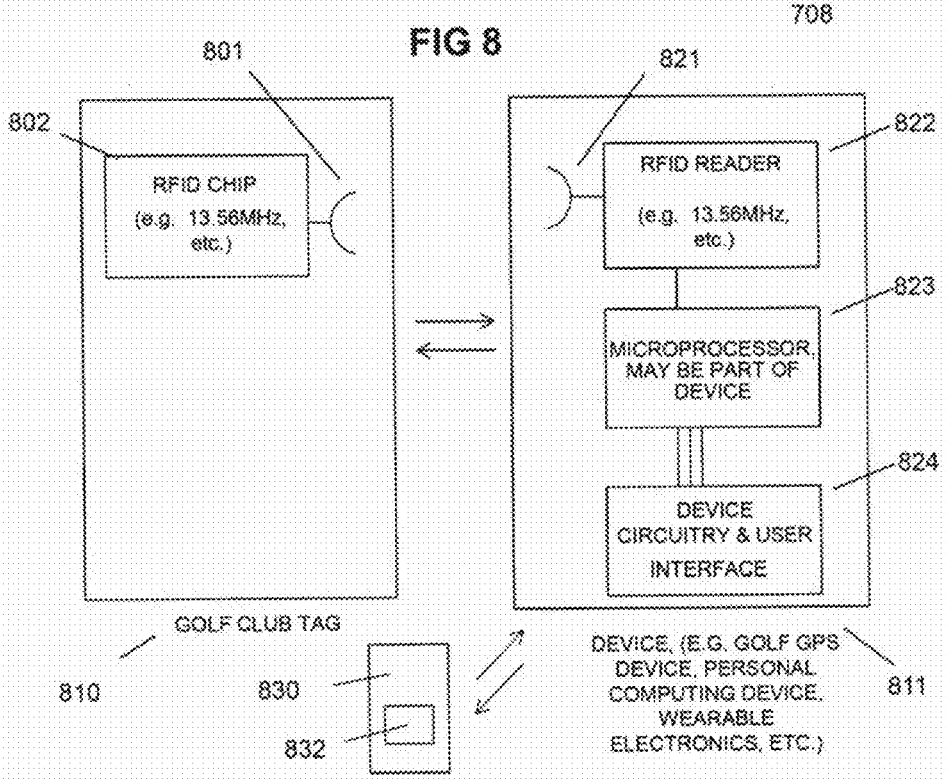
FIG. 8 shows a block diagram of system with a passive RFID tag embedded or attached to a golf club grip/club and a RFID reader incorporated into a device, such as a personal computing device, golf GPS device, wearable electronics, etc., networked with a server.

In an embodiment, a passive RFID tag, such as a NFC tag, may be in communication with a reading device to create the system shown in FIG. 8. The tag 810 includes an antenna 801 and a RFID chip 802. The tag 810 communicates with the device 811 (e.g. golf GPS device, personal computing device, wearable electronics, etc.) and may be affixed to a grip, such grip attached to a golf club. The device 811 may include an antenna 821, a RFID reader 822, a microprocessor 823 and device circuitry and user interface 824. The device 811 may accumulate information over many days, weeks, months, years, etc. about the usage of one or more golf clubs, and this information may include a list of golf courses played, how often the club is used and how often the user plays golf. The device 811 may record the days or dates that golf was played, how often the golf club was used on those days, and an identifier of each golf course played by the golfer. The identification of a golf course may be derived from the location information obtained from a GPS receiver used during play of the golf games. A GPS receiver, not shown in FIG. 8, may be included in device 811 or separately housed yet functionally coupled via wired or wireless communication to the device 811.

The golf information may be accumulated over time and shared through a data network, such as a cellular telephone network or the Internet, etc., to the manufacturer of the golf club or to another golf club manufacturer or to other golf equipment manufacturers or to retailers or other distributors of golf equipment. The accumulated information may be, in one embodiment, uploaded from the device 811 to a data processing system (e.g. a server 830) used by the manufacturer or manufacturers or retailers or other distributors, either directly from the device 811 (e.g. through a WiFi or Ethernet or cellular telephone connection provided by the device 811 or other coupled personal computing device), or the accumulated information may be transferred to another device (e.g. a laptop computer or other data processing system), which is not shown, and in turn the other device may upload the accumulated information (e.g. via the Internet) to the server 830 used by the manufacturer or manufacturers or retailers or other distributors. Transmitted information may be stored in an information database 832 located on server 830. Server 830 may be the same or different than server 710. Furthermore, information database 832 may be the same or different than tag identification database 708. In an embodiment, server 710 and server 830 communicate across a distributed network and tag identification database 708 and information database 832 represent tables of a relational database. Data, including and in addition to the accumulated information, may be communicated in either direction between server 830 and device 811.

Figure 9:
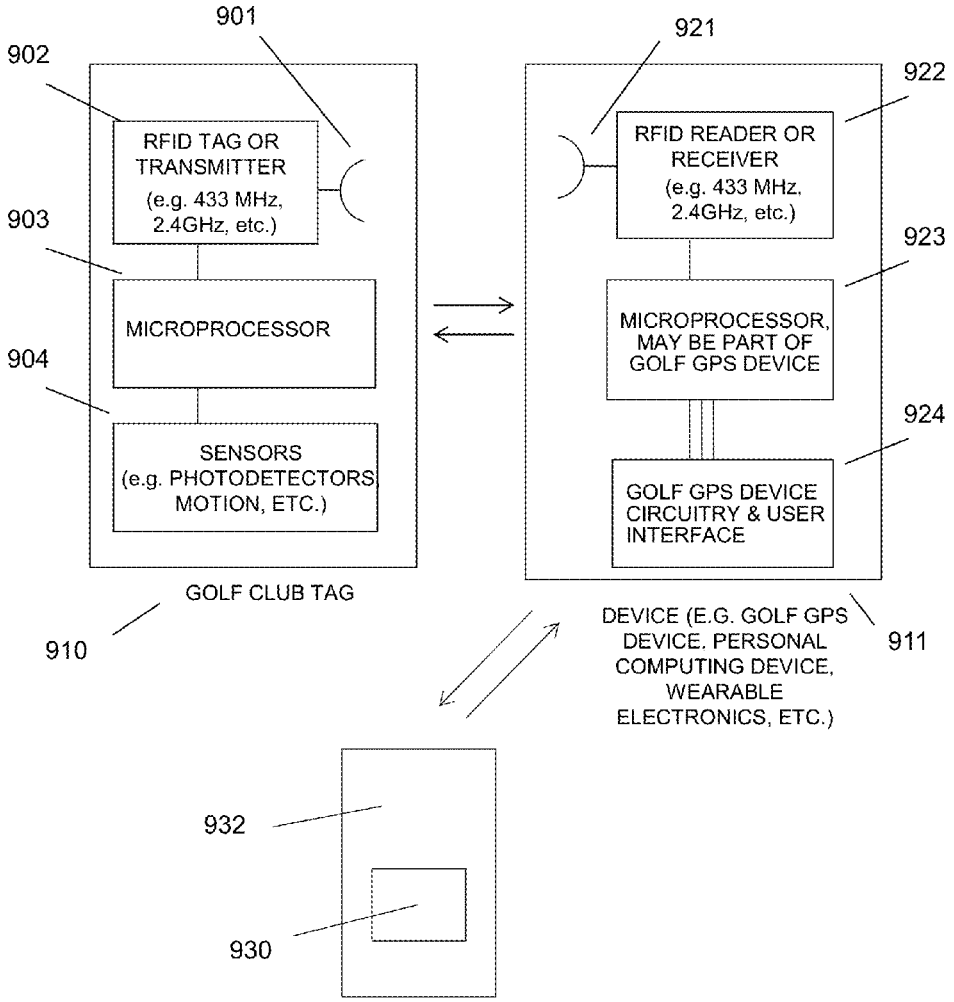
FIG. 9 shows a block diagram of system with an active RFID tag embedded or attached to a golf club grip/club and a RFID reader incorporated into a device, such as a personal computing device, golf GPS device, wearable electronics, etc., networked with a server.

In an embodiment, an active RFID tag, such as a 2.4 GHz Bluetooth tag, may be in communication with a reading device to create the system shown in FIG. 9. The tag 910 may include an antenna 901, a transmitter or RFID chip 902, microprocessor 903 and optional sensors 904. The tag 910 communicates with the device 911 (e.g. golf GPS device, personal computing device, wearable electronics, etc.) and may be affixed to a grip, such grip attached to a golf club. As mentioned herein, a combination of club tag types (e.g. active and passive) and other marking media (e.g. bar codes) may be affixed to the golf grip and/or club for purposes of recording and tracking information unique to such club. As above, tag identification information, such as a unique identifier of a tag chip, as well as usage information associated with an object to which the tag is attached, such as golf information, may be transmitted from tag 910 through one or more device 911 to one or more database 930 at one or more server 932.

In an embodiment, information associated with a tag either inherently or characteristically may be stored directly on a device. For example, using the system illustrated in FIG. 9 as an example, device 911 may include a data storage device having computer usable memory used to store a database, e.g., database 832, directly on device 911. Thus, device 911 may store a local repository of tag identification information, e.g., tag UID, or golf information, e.g., number of uses of a club associated with the tag.

Figure 10:
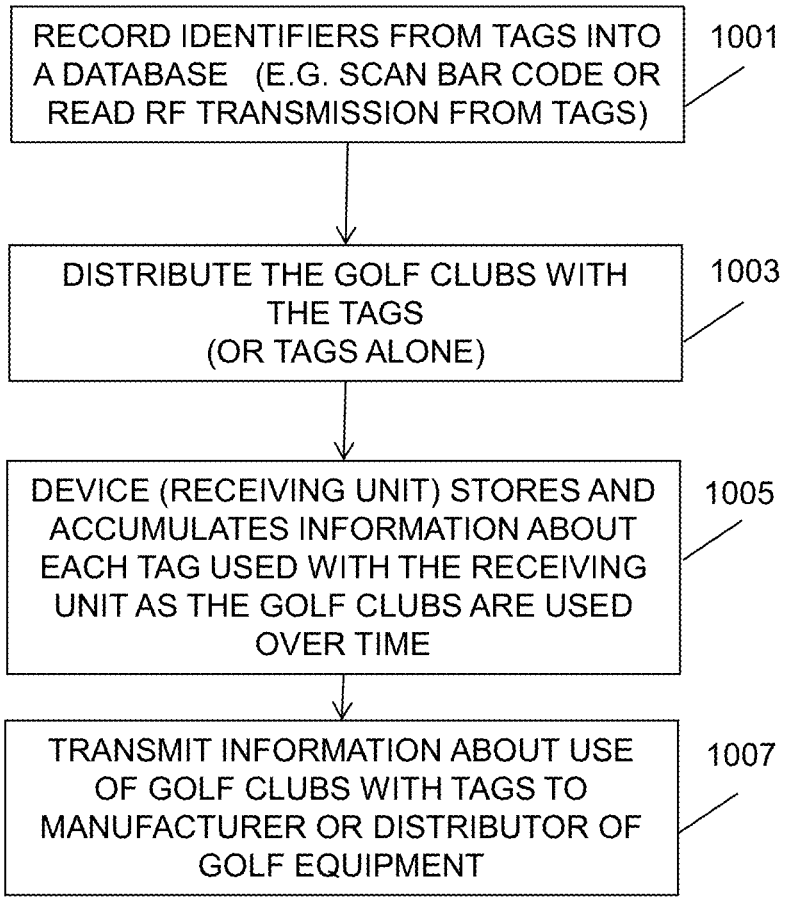
FIG. 10 is a flowchart that shows an example of a method for obtaining information about golf clubs after they are distributed to golfers according to one embodiment.

FIG. 10 shows an example, according to an embodiment, of how to operate a data collection system, such as a data collection system at a golf club manufacturer or golf equipment distributor, golf retailer, etc. The data collection system, in one embodiment, uses a device (e.g. GPS golf rangefinder that accompanies the golfer) and collects information about golf club usage in the presence of the device.

In the method of FIG. 10, a user (e.g. golf club manufacturer) may associate the unique identifiers from the tags with golf clubs having been made previously by virtue of operation 1001 in which the manufacturer records identifiers from the tags into a database. This may be performed by scanning a bar code or by reading the RF transmission from the tags on the golf clubs or by reading the tags with a RFID reader. This is performed prior to distributing the golf clubs with the tags in operation 1003. In other words, the golf club manufacturer or the tag manufacturer may record this information into a database prior to distributing the golf clubs or the tags separately to golfers. When a end-user device (e.g. golf GPS device) transmits the information (e.g. uploads the information wirelessly via the Internet to a database), as in operation 1007, the information may include the identifiers previously recorded, which may allow the golf club manufacturers or golf equipment distributors to associate the information with the previously stored identifiers for each golf club or tag. The device or receiving unit, in operation 1005, stores and accumulates the information about each tag as described herein prior to transmitting the information in operation 1007. As discussed above, the receiving unit may be a mobile device used to read the tag, or a remote server networked with such mobile device. Information may be received by the mobile device by bringing it within communication range of the tag, and automatically or manually establishing communication with the tag. In an embodiment, presence of the tag is detected by establishing communication with the tag.

Golf grips can get worn over time and with usage. It is common for a golfer to replace a golf grip with a new grip during the life of a golf club. This process of "re-gripping" may be due to the grip being worn or due to the golfer wanting to change to a different type of grip for other reasons. Golf grip manufacturers may want the golfer to re-grip often in order to sell more golf grips.

Figure 11:
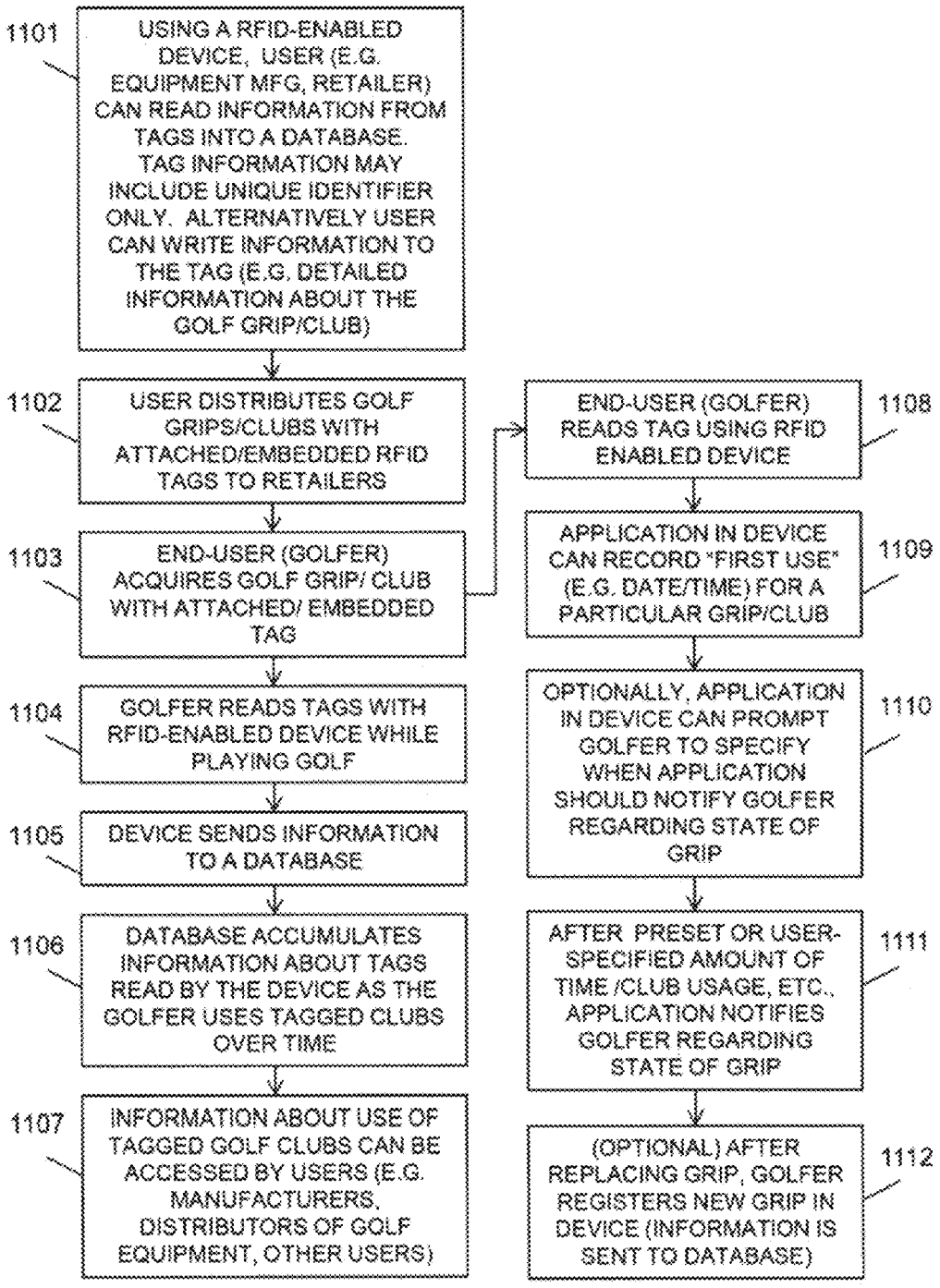
FIG. 11 is a flowchart that shows an example of a method for obtaining information about golf clubs after they are distributed to golfers according to one embodiment and a technique to remind golfers to replace grips.

In an embodiment, as shown in FIG. 11, a method to remind golfers about the state of a golf grip is described. In operation 1101 a user, such as a golf club manufacturer, may read the unique identifier in the grip/club-affixed (i.e. tag is affixed to grip and grip is affixed to club) RFID tag and store the identifier in a database. Additionally, the golf club manufacturer may write information to the grip/club-affixed tag using a RFID writer at the point of manufacture or distribution. For example, club-specific information associated with a club affixed to the grip may be written to the RFID tag. This club-specific information may be stored in the RFID tag and the database for future retrieval keyed to the RFID tag UID. In 1102, the user distributes the golf equipment with the affixed RFID tags, after having read and stored the unique identifiers in a database. Thus, such database may associate the unique identifier from the RFID tag with specific information about the particular piece of equipment (e.g. a club type of a golf club). An end-user (e.g., a golfer) may purchase the golf equipment at a golf retail location, per 1103 and, likely as part of a tag-specific or golf-specific application on a smart phone or other device, the golfer may read the tag with a RFID-enabled device while playing golf, per 1104. One potentially useful application of tagged golf clubs is to capture data while playing golf. As the golfer plays golf and records the clubs and locations of golf shots using tagged golf clubs and RFID-enabled devices, the data may be sent (e.g. wirelessly, via the Internet) to a database, per 1105. The information stored in the database may capture information about the behavior of the golfer, such as: how often the golfer plays, where the golfer plays, what type of equipment the golfer uses, how often the golfer changes equipment, etc., per 1106. This information, per 1107, may be made available to users such as golf equipment manufacturers, golf application providers, etc.

In an embodiment, a golfer acquires the equipment in 1103. A RFID tag and/or golf application (e.g. on a smart phone or other device) may be configured to notify a golfer that is it time to replace the grip or re-grip the golf club. The golfer may download an application (e.g. onto a smart phone) upon or after purchasing the tagged equipment. In 1108, the golfer may read the tagged grip for the first time and the application may record and store the initial read of the specific tagged grip, per 1109. Alternatively, the information associated with the initial read, e.g., date and time, may be captured and transmitted to a database for storage in association with a tag UID. Reading the tagged grip may include bringing an RFID-enabled device within a certain range of the RFID tag to cause the RFID-enabled device to detect the presence of the RFID tag. For example, in relation to FIG. 7, device 705 may be brought within a distance of about six inches from a passive NFC tag 701 to automatically detect the NFC tag. In an embodiment, a user may tap device 705 against grip 702, and upon contact between device 705 and grip 702, device 705 may detect and read tag 701. Alternatively, reading the tagged grip may include a RFID-enabled device receiving data transmissions from another type of tag (e.g. active 2.4 GHz Bluetooth tag). Tag transmissions may be triggered, in one example, by proximity sensing between the tag and the device. Alternatively, a tag may be equipped with other sensing means (such as light, impact, vibration, acceleration, etc.) which may automatically trigger data transmissions from a tag to a RFID-enabled device.

As described in 1110, the application may prompt the golfer, requesting the golfer to decide when re-gripping of that club is desired. For example, the golfer may be prompted to provide a user input specifying a regrip condition. The regrip condition may be open-ended, e.g., the user may be prompted to input an integer corresponding to a duration until the club is deemed due for regripping. For example, the integer may correspond to a number of swings of the golf club before regripping is desired. Alternatively, the user input may include a user selection. For example, the golfer may be presented with a list of regrip conditions to choose from. In an embodiment, the options offered may include a) in a specified amount of time, such as a year, b) after a specified number of rounds of golf, such as 50, c) after a specified number of uses, such as 200, d) never, etc.

Monitoring of progress toward the regrip condition may depend on, or be independent of, future interaction between the mobile device having the golf application and the RFID tag. A time-based regrip condition independent of future interaction is specified, e.g., regrip after a year from receiving the user input. Thus, progress toward the regrip condition may be monitored by the golf application by tracking a clock associated with a mobile device having the golf application. In an embodiment, a count-based regrip condition independent of future interaction is specified, e.g., regrip after 25 rounds of golf. Thus, progress toward the regrip condition may be monitored by the golf application by tracking user inputs specifying that a new round of golf is being played. In an embodiment, a count-based regrip condition dependent on future interaction is specified, e.g., regrip after 500 swings of a golf club having the golf grip. Thus, progress toward the regrip condition may be monitored by bringing the mobile device within communication range of the golf grip each time the golf club is swung to register a count in the golf application or a database linked to the golf application.

When the golf application determines, or receives notification from an external process that it has been determined, that the regrip condition is met, the application may provide a notification to the golfer indicating that the golf grip is due for replacement. In an embodiment, the golfer is provided with a message that appears on the display of the golf GPS device or personal computing device, such as "The grip on your 4-iron is due to be replaced", per 1111. Other techniques to remind the golfer may include sending the golfer a text or an email, or displaying a notification when logging into the golf application online.

After replacing a golf grip on a golf club with a replacement grip, the replacement grip may be associated with information about the golf club that was previously captured and/or stored through communication with the original golf grip. Replacement grips may include a new tag, with its own unique identifier and potentially other information (e.g. type of grip). However, the previously stored information about the golf club and usage of the golf club may nonetheless be important to evaluating behavior trends of the golfer. For example, even though the grip has changed, the past use of the golf club, e.g., past shots made with the golf club, may still be relevant to evaluating golfer use of the club with the new grip. Accordingly, a method of associating the replacement grip with the past information, e.g., club-specific information or usage information associated with the original UID, may be provided.

When a golf grip is replaced and first brought into communication range of a mobile device having a golf application, the mobile device may detect the presence of the different RFID tag coupled with the replacement grip and recognize that it includes a different UID than those previously received through the mobile device. In response, the golfer may be prompted with a guide to associating the replacement golf grip with the information associated with the original golf grip. The guide may usher the end-user through a process of associating the new replacement grip, per 1112. For example, the golfer may be presented with an option to associate the replacement golf grip with a golf club previously registered with the golf application. By doing so, the replacement UID may be transmitted to a server and associated with the original UID in a database. Thus, the replacement UID may be linked to information stored along with the original UID in the database, including club-specific and usage information associated with the original UID.

It should be understood that there are various other uses for this type of RFID golf club tag system. For example, this type of RFID tag and tracking system may be used by golf equipment manufacturers for preventing/deterring counterfeit equipment. For example, unique identifiers affixed to golf equipment in a permanent or semi-permanent manner may be stored in a database of "authentic" equipment. At the retail level, a user (e.g. a consumer, a retailer or employee of the golf equipment maker, etc.) may read the tagged equipment with a RFID-enabled device. The identifier read by the device may be transferred to the database and compared against the list of authentic identifiers and the application may present the user with a message authenticating the golf grip or golf club. For example "This is an authentic Ping driver".

This type of system may be used as a point-of-sale enhancement. For example, in an embodiment, an end-user may read a tag on a golf grip or a golf club at a retail location and view an advertisement about that specific piece of golf grip or golf club equipment on the end-user's smart phone.

This type of system may be used for end-user generated messages related to equipment "lost and found". For example, in an embodiment, an end-user may write (either directly to an equipment-affixed tag or, for example, to a website associated with the tag) a message such as "This is John Smith's pitching wedge. Click here to send John a text including the location of the found golf club", etc. Thus, if another golfer finds a tagged golf club that has been left behind or lost, the other golfer may read the tag, see the message and communicate with the owner of the equipment.

This type of system may be used for retail-level tracking. For example, in an embodiment, a tagged piece of equipment at a retail location may be read by an employee of the manufacturer of the piece of equipment. The employee may use a RFID-enabled device to read the tagged item. The employee may have a version of an application on the employee's device that enables the employee to see certain data either stored on the tag or in the database (i.e. the employee may be able to see information that a consumer, for example, may not be able to see). This may be accomplished by using a key code in the application, by providing different versions of the application to employees, or providing access to certain features in an application accessible with a password or code only. The retail-level tracking information may include, for example, the distribution facility the equipment was shipped from, the ship date, the retailer the equipment was shipped to, etc. This information may be valuable to the equipment manufacturer because it is a known problem in the retail business that equipment may end up at a retail location where it may not supposed to be.

This type of system may be used for television or radio broadcast enhancement. For example, in an embodiment, when a televised golfer (e.g. professional, collegiate or other) chooses a golf club to use for a specific golf shot, the system described herein could add value to the broadcast by confirming the golf club the golfer is about to use. It is common for a broadcaster to inform the viewing/listening audience which golf club the golfer is about to use. Currently, a broadcaster has to rely on information relayed by the golfer's caddie or another person, via verbal communication, which can then be communicated to the broadcaster via radio or wireless communication. Using the system described herein, the golfer's caddie could remove a golf club and before handing it to the golfer the caddie could read the tagged club with a RFID-enabled device and the device, or a server networked with the device, may wirelessly transmit the information to whomever is granted access rights to the information, including the broadcaster.

Figure 12:
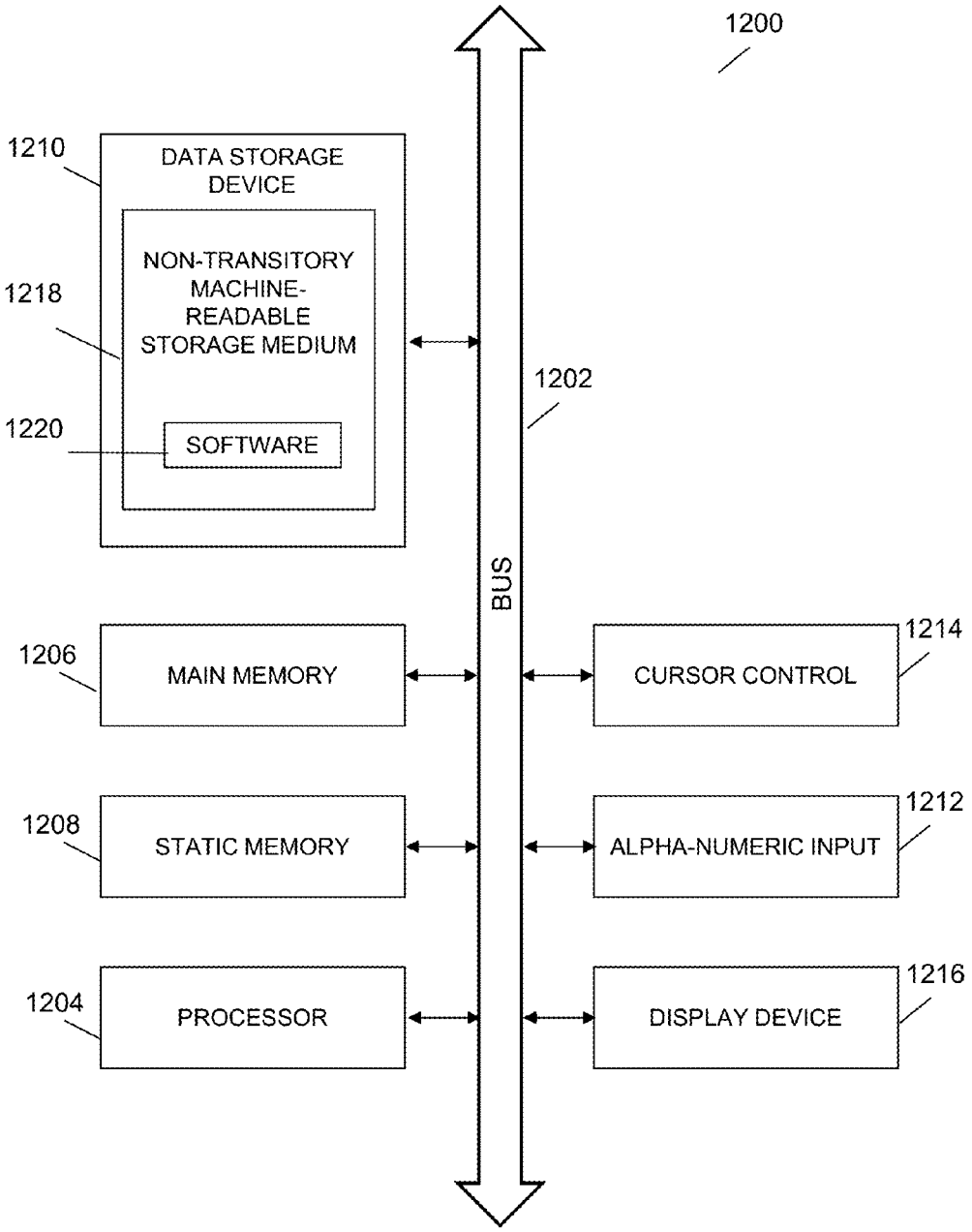
FIG. 12 is a schematic illustration of computer system that may be used in accordance with an embodiment.

Referring to FIG. 12, a schematic illustration of a computer system that may be used is shown in accordance with an embodiment. Portions of embodiments are comprised of or controlled by non-transitory machine-readable and machine-executable instructions which reside, for example, in machine-usable media of a computer system 1200. Computer system 1200 may be representative, for example, of portions of devices 705, 811, and/or 911, or of portions of servers 710, 830, and/or 932. Computer system 1200 is exemplary, and embodiments may operate on or within, or be controlled by a number of different computer systems including general purpose networked computer systems, embedded computer systems, routers, switches, server devices, client devices, various intermediate devices/nodes, stand-alone computer systems, and the like.

Computer 1200 of FIG. 12 includes an address/data bus 1202 for communicating information, and central processor unit 1204 connected to bus for processing information, e.g., tag identification data, golf information, and instructions. Computer 1200 also includes data storage features such as computer usable volatile memory 1206, e.g. random access memory (RAM), connected to bus 1202 for storing information and instructions for central processor unit 1204, computer usable non-volatile memory 1208, e.g. read only memory (ROM), connected to bus 1202 for storing static information, e.g., tag identification data or golf information data, and instructions for the central processor unit 1204, and data storage device 1210 (e.g., a magnetic or optical disk and disk drive) connected to bus 1202 for storing information and instructions. Computer 1200 of the present embodiment also includes an optional alphanumeric input device 1212 including alphanumeric and function keys connected to bus 1202 for communicating information and command selections to central processor unit 1204. Computer 1200 also optionally includes an optional cursor control device 1214 connected to bus 1202 for communicating user input information and command selections to central processor unit 1204. Computer 1200 of the present embodiment also includes an optional display device 1216, such as a monitor connected to bus 1202 for displaying, e.g., golf or golf club information.

The data storage device 1210 may include a non-transitory machine-readable storage medium 1218 on which is stored one or more sets of instructions (e.g. software 1220, which may be golf application software 704) embodying any one or more of the methodologies or operations described herein. Software 1220 may also reside, completely or at least partially, within the computer usable volatile memory 1206, computer usable non-volatile memory 1208, and/or within central processor unit 1204 during execution thereof by computer 1200, the computer usable volatile memory 1206, computer usable non-volatile memory 1208, and/or central processor unit 1204 also constituting non-transitory machine-readable storage media.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A non-transitory computer readable medium storing executable instructions, which when executed cause a RFID-enabled device to perform a method comprising:

detecting, by a RFID-enabled device, presence of a RFID tag coupled with a golf grip;

receiving an input specifying a regrip condition, wherein the input is a user input;

prompting the user to provide the user input in response to detecting an initial presence of the RFID tag, wherein the user input specifies a duration; and providing, in response to the regrip condition being met, a notification indicating the golf grip is due for replacement.

2. The medium of claim 1, wherein the RFID tag includes a near field communication (NFC) tag, and wherein detecting presence of the NFC tag includes contacting the RFID-enabled device to the golf grip.

3. The medium of claim 1, wherein the user input includes a user selection, and wherein the duration is selected from at least one of a specified amount of time, a specified number of uses of the golf grip, or a specified number of golf rounds.

4. The medium of claim 1 further comprising:

receiving a unique identifier (UID) associated with the RFID tag;

detecting presence of a different RFID tag coupled with a replacement grip, wherein the different RFID tag is associated with a different UID; and associating the replacement grip having the different UID with the received UID.

5. The medium of claim 4 further comprising:

capturing information associated with a golf club coupled with the golf grip, wherein associating the replacement grip with the received UID includes associating the different UID with the captured information.

6. The medium of claim 5, wherein the captured information includes usage information or club-specific information.

7. A machine implemented method, comprising:

storing a unique identifier (UID) associated with a RFID tag, the RFID tag coupled with a golf grip;

receiving identification information associated with a candidate golf grip, wherein the identification information includes a candidate UID;

comparing the candidate UID with the stored UID to determine whether the candidate golf grip is the golf grip; and providing, in response to determining the candidate golf grip is the golf grip, a notification, wherein the notification includes a message associated with the stored UID and wherein the message prompts a user to provide an input specifying a regrip condition.

8. The method of claim 7 further comprising:

storing, in response to determining the candidate golf grip is the golf grip, usage information associated with a golf club coupled with the candidate golf grip; and receiving a request for the stored information associated with the golf club; and providing, based on access rights included in the request, the requested information associated with the golf club.

9. The method of claim 8, wherein the stored information associated with the golf club includes at least one of club-specific information or usage information.

10. The method of claim 9 further comprising determining, based on the usage information, behavior of a user of the golf club.

11. The method of claim 10, wherein determining behavior of the user includes determining at least one of how often the user plays golf, where the user plays golf, what type of golf equipment the user plays golf with, or how often the user changes golf equipment.

12. The method of claim 7, wherein the message authenticates a golf club coupled with the golf grip.

13. The method of claim 7, wherein the message provides an advertisement about a golf club coupled with the golf grip.

14. The method of claim 7, wherein the message includes a message written by a user to a website associated with the RFID tag.

15. The method of claim 7, wherein the message includes club-specific information, and wherein the club-specific information includes a type of a golf club coupled with the golf grip.

16. The method of claim 7, further comprising:

providing, in response to determining the candidate golf grip is not the golf grip, a notification, wherein the notification includes a guide to associating the candidate golf grip with the stored UID.

* * * * *